United States Patent [19]

Zink

[11] Patent Number: 4,770,904

[45] Date of Patent: Sep. 13, 1988

[54] PROCESS FOR THE PREPARATION OF A PRESSURE-SENSITIVE RECORDING MATERIAL

[75] Inventor: Rudolf Zink, Therwil, Switzerland

[73] Assignee: Ciba-Geigy Corporation, Ardsley, N.Y.

[21] Appl. No.: 4,370

[22] Filed: Jan. 16, 1987

[30] Foreign Application Priority Data

Jan. 23, 1986 [CH] Switzerland ..... 255/86

[51] Int. Cl.[4] ..... B41M 5/16

[52] U.S. Cl. ..... 427/150; 427/151; 503/213; 503/215; 503/220; 503/221; 503/223

[58] Field of Search ..... 427/150–152; 503/200, 217, 218, 225, 213, 215, 220, 221, 223

[56] References Cited

U.S. PATENT DOCUMENTS 4,376,150 3/1983 Morita et al. ..... 427/150

*Primary Examiner*—Bruce H. Hess

*Attorney, Agent, or Firm*—Edward McC. Roberts; Meredith C. Findlay

[57] ABSTRACT

There is disclosed a process for the preparation of a pressure-sensitive recording material which contains in its color forming system a color former and a developer therefor, which process comprises using said color former in the amorphous state.

When the color former is in this state, it dissolves more readily and the pressure-sensitive recording material so obtained has good color forming properties and enhanced color strength.

6 Claims, No Drawings

PROCESS FOR THE PREPARATION OF A PRESSURE-SENSITIVE RECORDING MATERIAL

The present invention relates to a process for the preparation of a pressure-sensitive recording material.

It has been found that the solubility of a colour former can be enhanced by using the colour former in the amorphous state. When the colour former is in this state, it dissolves more readily and time and energy are saved. The pressure-sensitive recording material so obtained has good colour forming properties and enhanced colour strength.

Accordingly, the present invention relates to a process for the preparation of a pressure-sensitive recording material containing in its colour forming system a colour former and a developer therefor, which process comprises using the colour former in the amorphous state.

The colour formers eligible for use in the process of this invention are colourless or faintly coloured chromogenic compounds which, when contacted with the developer, become coloured or change colour. It is possible to use colour formers or mixtures thereof, e.g. those belonging to the classes of the azomethines, fluoranes, benzofluoranes, phthalides, azaphthalides, spiropyranes, spirodipyranes, leucoauramines, quinazolines, triarylmethane leuco dyes, carbazolylmethanes, chromenoindoles, rhodamine lactams, chromenopyrazoles, phenoxazines and phenothiazines, as well as of the chromeno or chromano colour formers. Examples of suitable colour formers are: triarylmethanes, e.g. crystal violet lactone, 3,3-(bisaminophenyl)phthalides,
3,3-(bis-substitutedindolyl)phthalides,
3-(aminophenyl)-3-indolylphthalides,
3-(aminophenyl)-3-indolylazaphthalides,
6-dialkylamino-2-n-octylaminofluoranes,
6-dialkylamino-2-arylaminofluoranes, e.g.
6-diethylamino-2-(2'-chlorophenylamino)fluorane,
6-dibutylamino-2-(2'-chlorophenylamino)fluorane;
6-dialkylamino-3-methyl-2-arylaminofluorane, e.g.
2-anilino-3-methyl-6-diethylaminofluorane or
2-(2',4'-dimethylanilino)-3-methyl-6-diethylaminofluorane,
6-dialkylamino-2- or 3-lower alkylfluoranes,
6-dialkylamino-2-dibenzylaminofluoranes,
6-pyrrolidino-2-dibenzylaminofluorane,
6-N-cyclohexyl-N-loweralkylamino-3-methyl-2-arylaminofluoranes,
6-pyrrolidino-2-arylaminofluoranes,
6-dialkylamino-3-methyl-2-diaralkylaminofluoranes,
bis(aminophenyl)furyl- or -phenyl- or -carbazolylmethanes, e.g.
bis(N-alkyl-N-arylaminophenyl)-N-alkylcarbazol-3-ylmethanes,
3'-phenyl-7-dialkylamino-2,2'-spirodibenzopyranes,
bisdialkylaminobenzhydrol alkyl- or arylsulfinates,
mono- or bis-2-aminophenylaryloxyquinazolines or
benzoyldialkylaminophenothiazines or -phenoxazines.

The amorphous state of the colour former is obtained by heating at least one chromogenic compound of the above mentioned kind which is in crystalline form to give a melt, cooling said melt and then pulverising the resultant solid. In powder form, the colour formers are substantially dust-free and have an advantageous bulk density. Preferred colour formers in the amorphous state have a softening point in the range from 30° to 130°

C., i.e. 40° to 100° C. lower than the respective original melting point. The amorphous state can also be obtained by fusing the chromogenic compound, together with other organic compounds such as higher hydrocarbons, e.g. kerosene, or polyethylene glycols, to form a homogeneous melt.

A pressure-sensitive recording material normally comprises a pair of sheets, the topmost one being coated on its underside with a composition consisting principally of microcapsules that can be ruptured by pressure and which encapsulates an oily material in which the colour former is dissolved. The second sheet is coated with another composition comprising mainly an electron acceptor or developer.

The colour former solution effects a coloured mark at those points where it comes into contact with the developer. To prevent the colour formers contained in the pressure-sensitive recording material from becoming active prematurely, they are usually separated from the electron acceptor. This separation can conveniently be accomplished by incorporating the colour formers in foam-like, sponge-like or honeycomb-like structures. The colour formers are preferably encapsulated in microcapsules, which can normally be ruptured by pressure.

The amorphous colour formers are normally encapsulated in the form of solutions in organic solvents. Using an amorphous colour former, these solutions form surprisingly rapidly, with the colour former being distinguished by an enhanced dissolving rate. Hence the process of this invention achieves a more rapid rate of solubilisation, thus reducing energy consumption. This constitutes an advance in the art. Examples of suitable solvents are preferably non-volatile solvents, for example a polyhalogenated paraffin such as chloroparaffin, or a polyhalogenated diphenyl such as monochlorodiphenyl or trichlorodiphenyl, and also tricresyl phosphate, di-n-butyl phthalate, dioctyl phthalate, trichlorobenzene, trichloroethylphosphate, an aromatic ether such as benzylphenyl ether, a hydrocarbon oil such as paraffin or kerosene, an alkylated (e.g containing isopropyl, isobutyl, sec- or tert-butyl groups) derivative of diphenyl, diphenylalkane, naphthalene or terphenyl; dibenzyl toluene, terphenyl, partially hydrogenated terphenyl, a benzylated xylene, or other chlorinated or hydrogenated condensed aromatic hydrocarbons. Mixtures of different solvents, especially mixtures of paraffin oils or kerosene and diisopropylnaphthalene or partially hydrogenated terphenyl, are often used to obtain maximum solubility for the colour formation, a rapid and intense coloration, and a viscosity which is advantageous for the microencapsulation.

The capsule walls can be formed evenly around the droplets of the colour former solution by coacervation; and the encapsulating material may consist of gelatin and gum arabic, as described e.g. in U.S. Pat. No. 2,800,457. The capsules can also be formed conveniently from an aminoplast or a modified aminoplast by polycondensation, as described in British patent specifications Nos. 989 264, 1 156 725, 1 301 052 and 1 355 124. Also suitable are microcapsules which are formed by interfacial polymerisation, e.g. capsules formed from polyester, polycarbonate, polysulfonamide, polysulfonate, but in particular from polyamide or polyurethane. The colour former microcapsules can also be prepared by in situ polymerisation.

The capsules are preferably secured to the support by means of a suitable adhesive. As paper is the preferred support, this adhesive is principally a paper-coating agent, for example gum arabic, polyvinyl alcohol, hydroxymethylcellulose, casein, methyl cellulose, dextrin, starch or a starch derivative or a polymer lattice. These latter are e.g. butadiene/styrene copolymers or acrylic homopolymers or copolymers.

The paper employed comprises not only normal paper made from cellulose fibres, but also paper in which the cellulose fibres are replaced (partially or completely) by synthetic polymers.

Inorganic acceptors may suitably be employed as acceptors or developers. These are as a rule activated clays such as attapulgite, acid clay, bentonite, montmorillonite, activated clay, e.g. acid-activated bentonite or montmorillonite, and also zeolith, halloysite, silica, alumina, aluminium sulfate, aluminium phosphate, zinc chloride, zinc nitrate, activated kaolin or any clay, or acidic organic compounds, for example unsubstituted or ring-substituted phenols, salicylic acid or salicylates and their metal salts, or an acidic polymer, for example a phenolic polymer, an alkylphenol acetylene resin, a maleic acid/rosin resin or a partially or completely hydrolysed polymer of maleic acid and styrene, ethylene or vinyl methyl ether, or carboxypolymethylene. Mixtures of these polymers can also be used. Preferred developers are acid-activated bentonite, zinc salicylates, or the condensates of p-substituted phenols with formaldehyde. These last mentioned compounds may also contain zinc.

The developers may also be used in admixture with other basically inert or substantially inert pigments or with other auxiliaries such as silica gel or UV absorbers, e.g. 2-(2-hydroxyphenyl)benzotriazoles. Examples of such pigments are: talcum, titanium dioxide, zinc oxide, chalk, clays such as kaolin, as well as organic pigments, e.g. urea/formaldehyde condensates (BET surface area: 2–75 $m^2/g$) or melamine/formaldehyde condensates.

In the following preparatory Examples parts and percentages are by weight, unless otherwise stated.

EXAMPLE 1

150 g of crystalline 3,3-bis(4'-dimethylaminophenyl)-6-dimethylaminophthalide (crystal violet lactone) with a melting point of 175°–178° C. (prepared in accordance with No. GB-B-1 347 467) are heated to 200° C. A clear melt is obtained. The melt is cooled and the solid is then pulverised, affording 150 g of amorphous product with a softening point of 98°–106° C. Compared with the starting material, this product has an appreciably better solubility and bulk density and is substantially dust-free.

EXAMPLE 2

1 g of the amorphous crystal violet lactone prepared in Example 1 is stirred at 20° C. in 99 g of diisopropylnaphthalene (mixture of isomers) and the solution formed after 10 minutes is filtered. This solution is microencapsulated by coacervation in a manner known per se with gelatin and gum arabic. The microcapsules are mixed with starch solution and coated on a sheet of paper. The face of a second sheet of paper is coated with a conventional phenolic resin as developer. The first sheet and the sheet coated with the developer are laid on top of each other with the coated sides face to face. Pressure is exerted on the first sheet by writing by hand or typewriter and a very strong blue copy develops immediately on the sheet coated with the developer.

EXAMPLE 3

1 g of the amorphous 2-phenylamino-3-methyl-6-diethylaminofluorane (softening point 108°–110° C.) is stirred at 90° C. in partially hydrogenated terphenyl and dissolved over 1½ minutes at 90° C. This solution is microencapsulated by coacervation in a manner known per se with gelatin and gum arabic. The microcapsules are mixed with starch solution and coated on a sheet of paper. The face of a second sheet of paper is coated with a conventional phenolic resin as developer. The first sheet and the sheet coated with the developer are laid on top of each other with the coated sides face to face. Pressure is exerted on the first sheet by writing by hand or typewriter and a strong grey copy develops immediately on the sheet coated with the developer.

The colour formers prepared in accordance with Example 1 and listed in the following Table have a comparably advantageous solubility and give strong colourations when used as described in Examples 2 and 3.

TABLE

| Example | Colour former | Softening point in °C. | Shade |
|---|---|---|---|
| 4 | 2-phenylamino-3-methyl-6-N—methyl-N—cyclohexylfluorane | 117–125 | black |
| 5 | 2-(2'-chlorophenylamino)-6-diethylaminofluorane | 104–115 | black |
| 6 | 3'-phenyl-7-diethylamino-2,2'-spiro-di-(2H—1-benzopyrane) | 84–88 | blue |
| 7 | 3,3-bis(1'-ethyl-2'-methylindol-3'-yl)-phthalide | 125–126 | red |
| 8 | 3-(1'-ethyl-2'-methylindol-3'-yl)-3-(2''-ethoxy-4''-diethylaminophenyl)-4-azaphthalide | 105–108 | blue |
| 9 | 2-octylamino-6-diethylaminofluorane | 57–60 | olive green |
| 10 | 2-dibenzylamino-6-diethylaminofluorane | 80–88 | green |
| 11 | 2-tert-butyl-6-diethylaminofluorane | 90–91 | orange |
| 12 | 2-(4'-dipropylaminophenyl)-4-phenoxyquinazoline | 35–40 | yellow |
| 13 | bis[4-(4',4''-isopropylidenediphenoxy)-2-(4'''-dimethylaminophenyl)]quinazoline | 105–110 | yellow |

EXAMPLE 14

(a) 1.3 g of 2-dibenzylamino-3-methyl-6-pyrrolidinofluorane (m.p. 213°–215° C.) and 2.7 g of 2-dibenzylamino-6-pyrrolidinofluorane (m.p. 179°–181° C.) are mixed and the mixture is heated to 200° C. The resultant clear melt is cooled and the solid is then pulverised, affording 4 g of a pale beige powder with a softening point of 108° C., which has excellent solubility in the solvents employed for the encapsulation.

(b) 4 g of the amorphous mixture obtained in (a) is stirred at 90° C. in 96 g of diisopropylnaphthalene (mixture of isomers) and dissolved at the same temperature over 1½ minutes. This solution is microencapsulated by coacervation in a manner known per se with gelatin and gum arabic. The microcapsules are mixed with starch solution and coated on a sheet of paper. The face of a second sheet of paper is coated with a conventional phenolic resin as developer. The first sheet and the sheet coated with the developer are laid on top of each other with the coated sides face to face. Pressure is exerted on the first sheet by writing by hand or typewriter and a strong and lightfast black copy develops immediately on the sheet coated with the developer.

I claim:

1. A process for the preparation of a color former sheet for a pressure sensitive recording material containing a pair of sheets, one coated with a composition containing the color former and the second containing an electron acceptor or developer, said process comprising:

(a) dissolving in a non-volatile organic solvent an amorphous color former capable of reacting with a color developer material;

(b) encapsulating the color former solution; and (c) coating the resulting microcapsules onto a sheet of support material.

2. A process according to claim 1, which comprises using an amorphous color former that has been obtained by heating a color former in crystalline form to a melt, cooling said melt, and pulverising the resultant solid.

3. A process according to claim 1, which comprises using an amorphous color former that has a softening point in the range from 30° to 130° C.

4. A process according to claim 1, wherein the color former is 3,3-bis(4'dimethylaminophenyl)-6-dimethylaminophthalide.

5. A process according to claim 1, wherein the color former is 2-phenylamino-3-methyl-6-diethylaminofluorane.

6. A process according to claim 1, wherein the color former is a mixture of 2-dibenzylamino-3-methyl-6-pyrrolidinofluorane and 2-dibenzylamino-6-pyrrolidinofluorane.

* * * * *